US011084063B2

(12) United States Patent
Bourely et al.

(10) Patent No.: US 11,084,063 B2
(45) Date of Patent: Aug. 10, 2021

(54) MACHINE AND METHOD FOR INSPECTING A FLOW OF OBJECTS

(71) Applicant: PELLENC SELECTIVE TECHNOLOGIES (SOCIETE ANONYME), Pertuis (FR)

(72) Inventors: Antoine Bourely, La Tour D'Aigues (FR); Gwénaële Le Corre, Pertuis (FR)

(73) Assignee: PELLENC SELECTIVE TECHNOLOGIES (SOCIETE ANONYME), Pertuis (FR)

( * ) Notice: Subject to any disclaimer, the term of this patent is extended or adjusted under 35 U.S.C. 154(b) by 0 days.

(21) Appl. No.: 16/079,824

(22) PCT Filed: Feb. 27, 2017

(86) PCT No.: PCT/FR2017/050432
§ 371 (c)(1),
(2) Date: Aug. 24, 2018

(87) PCT Pub. No.: WO2017/149230
PCT Pub. Date: Sep. 8, 2017

(65) Prior Publication Data

US 2019/0047024 A1 Feb. 14, 2019

(30) Foreign Application Priority Data

Mar. 1, 2016 (FR) ..... 1651728

(51) Int. Cl.
*B07C 5/342* (2006.01)

(52) U.S. Cl.
CPC ..... *B07C 5/342* (2013.01); *B07C 2501/0054* (2013.01)

(58) Field of Classification Search
CPC ..... B07C 5/02; B07C 5/342; B07C 5/3422; B07C 2501/0054; G01N 21/84; G01N 21/845; G01N 21/8455
See application file for complete search history.

(56) References Cited

U.S. PATENT DOCUMENTS 4,630,736 A * 12/1986 Maughan ..... B07C 5/366 209/581
5,165,068 A * 11/1992 Baldwin ..... H04N 1/486 348/104

(Continued)

FOREIGN PATENT DOCUMENTS

EP 1 243 350 A1 9/2002
EP 1 533 045 A1 5/2005

(Continued)

OTHER PUBLICATIONS

International Search Report, dated May 16, 20137 from corresponding PCT/FR2017/050432 application.

*Primary Examiner* — Joseph C Rodriguez
(74) *Attorney, Agent, or Firm* — IPSILON USA, LLP

(57) ABSTRACT

A machine for automatically inspecting a flow (F) of individual objects (2) on a conveying plane (3) includes at least one illumination station (4) and at least one detection station (4') below which the flow (F) of objects to be inspected passes. The at least one illumination station (4) has means (6) for applying and focusing inspecting beams (R) defining a transverse focused illuminated region (ZEF) The at least one detection station (4') has a means (9) defining a detection region (ZD) in the form of a transverse strip of size (L) as well as means (9,1) for capturing and transmitting the signal contained in a pixel (10) scanning the detection region (ZD). The focused illuminated region (ZEF) fits along the entire width (L) of the detection region (ZD) within this detection region.

14 Claims, 5 Drawing Sheets

(56) References Cited

U.S. PATENT DOCUMENTS 5,172,005 A * 12/1992 Cochran ..... G01N 21/8901 250/559.08
5,966,217 A * 10/1999 Roe ..... G01N 21/31 209/524
6,078,018 A * 6/2000 Davis ..... B07C 5/3416 209/580
6,410,872 B2 * 6/2002 Campbell ..... B07C 5/3422 209/576
6,497,324 B1 * 12/2002 Doak ..... B07C 5/342 209/522
6,603,103 B1 * 8/2003 Ulrich ..... G01B 11/2513 250/205
7,113,272 B2 * 9/2006 Bourely ..... B07C 5/342 356/237.1
7,262,380 B1 * 8/2007 Ulrichsen ..... B07C 5/368 209/577
8,116,554 B2 * 2/2012 Burton ..... B26D 5/007 382/141
8,411,276 B2 * 4/2013 Doak ..... B07C 5/342 356/445
9,316,596 B2 * 4/2016 Levesque ..... B07C 5/342
9,989,527 B2 * 6/2018 Petruno ..... G01N 21/8483
2002/0008055 A1 1/2002 Campbell et al.
2004/0095571 A1 * 5/2004 Bourely ..... B07C 5/342 356/237.1
2009/0032445 A1 * 2/2009 Doak ..... B07C 5/342 209/587
2012/0138514 A1 * 6/2012 Janssens ..... B07C 5/342 209/577

FOREIGN PATENT DOCUMENTS

WO 2013/115650 A1 8/2013
WO 2015/063300 5/2015

* cited by examiner

MACHINE AND METHOD FOR INSPECTING A FLOW OF OBJECTS

BACKGROUND OF THE INVENTION

Field of the Invention

This invention relates to the field of the automatic characterization, and optionally the classification, the sorting, the evaluation or the identification of objects or articles, or parts of the latter, traveling in a stream, in the form of individual and separate elements or an integral product traveling over a conveying plane. The non-destructive characterization is carried out by analysis of light rays that are reflected by the objects, articles or products subjected to corresponding incident radiation. An advantageous, but non-limiting, application of this type of so-called "optical sorting" technology is the sorting of household, institutional, or industrial waste, in particular recyclable household packaging.

Within this context, the invention proposes an improved machine and inspection method for carrying out an automatic characterization.

Description of the Related Art

Numerous embodiments of machines and optical sorting methods are already known, marketed, and implemented.

First of all, as regards the nature of used inspection or incident radiation, it is advisable to point out that the technology that is in question and that is implemented is based on the emission of non-coherent and wide-spectrum radiation. As a result, the machines and systems taken into account in the state of the art use all of the tungsten-halogen-type thermal illumination sources, more simply called "halogens," and not lasers or electroluminescent diodes. The halogens have a controlled spectral composition that depends only on the color temperature, and their spectrum covers the primary ranges of the optical sorting: from 400 nm to 2,500 nm. The other systems, and in particular the lasers, allow excellent monitoring of the illumination geometry, but they are clearly more expensive and more complex to control, which makes them solutions that are seldom used for optical sorting.

In an optical sorter, the elements for detection and illumination are normally located at significant distances from the streams to be sorted, from 300 mm to 2,000 mm. Actually, experience shows that 300 mm is the necessary height of the channel for passage of a stream of waste that is to be sorted, if the desire is to avoid the risks of jamming (wedging of objects in the machine, which triggers a blocking alert and halting of the sorting). As for large sizes (up to 2,000 mm), they correspond to the necessity of scanning a large conveyor width with a single device.

The concept of optical balance is therefore important for ensuring a good signal-to-noise ratio and therefore good real-time detection.

To improve the balance, an obvious solution can consist in maximizing the proportion of emitted photons that are effectively used in detection, which could be called "photonic effectiveness."

In this perspective, converging of the detection regions and illumination regions appears to be the optimum solution: all of the photons that are captured from the illumination line are collected and exploited by the sensors, and the sensors themselves are used over their entire surface.

However, most of the known systems do not come close to such a converging, in particular because of the difficulty of its practical implementation, taking into account tolerances of manufacturing and use in particular.

The traditional structure of known optical sorters uses diffuse illumination sources that have a large angle with the detection plane. They are frequently used because they are easy to produce and have a good variety of orientations for the illumination of objects, which is favorable.

However, they are confronted with the problem of field depth, to be able to analyze objects of a certain thickness. It is therefore necessary to them to illuminate not only the line of detection in the area of the belt, but also all of the detection lines located in the detection plane and above the belt. This implies that at each height, a small proportion of the illuminated region is in the field of the sensors.

To ensure photonic effectiveness, movable illumination, such as the one described in the patent application WO 2013/115650 A1, seems to be more advantageous, because the illumination is in this case directional, movable and coaxial with the detection. This assembly ensures in principle good energy savings since at any one time, only the vicinity of the pixel is illuminated during analysis.

However, in this known assembly, the illumination is also overflowing. The beams of two lights, focused by a single lens and reflected by a polygonal mirror, provide in the area of the belt a spot with a diameter that is close to 8 cm, which is much larger than the pixel. In addition, the coaxial movable illumination has a major drawback that limits its advantage: in transparent objects, such as plastic bottles or bags, very little signal is returned at 180° of the illumination direction, which completely compromises the detection quality.

More generally, any assembly with movable illumination, based on an incoherent source such as a halogen lamp, has great difficulties in concentrating the light on a small region, and therefore in improving the optical balance.

Only fiber-optic assemblies achieve proper confinement of the illumination, but at only several millimeters of the scene, which makes them unusable in optical sorting. In this category, the SRS, or Spatially Resolute Spectroscopy, detection systems are found.

Among the stationary illumination sources that operate at a great distance from the scene, only the illumination sources that are essentially coplanar with the detection or colinear (coaxial) can hope to confine the illumination. However, as indicated above, it is very difficult to design a colinear illumination of this type, which is not based on coherent light.

The implementation of an illumination and a detection that are essentially coplanar is disclosed by the document EP 1 243 350 and by the commercial documents of the applicant relative to its line of machines referred to as "Mistral."

In addition to the practical arrangement relative to coplanarity, the other primary characteristics and the mode of operation of the machine that is the object of the above-mentioned document are indicated below.

This known machine is designed primarily for the optical sorting of various objects and in particular waste for the purpose of the recycling thereof.

Said objects that are to be sorted are spread out in a loose single layer on a conveyor belt, whose width is generally between 600 mm and 3,000 mm, and whose speed is fixed, and between 2 m/s and 5 m/s.

One or more optical heads are placed side by side above the conveyor and via successive lines inspect its entire surface during its travel.

A focused illumination defines an illumination plane whose intersection with the belt defines an illumination line, and concentrates the majority of the radiation in a focused illumination region located in the immediate vicinity of the illumination line.

For each optical head, an oscillating-mirror-type scanner scans a measuring point from one edge to the next of the part of the illumination line that corresponds to the field of vision of the head. The period of analysis of a line, corresponding to a transverse scanning, is several milliseconds.

At any time, a single elementary measurement region located in the vicinity of the scanned point is displayed and analyzed, and the surface of the displayed region during an elementary measurement is called a pixel. The number of pixels analyzed by line is adjusted based on the scanned width to result in a lateral resolution of several millimeters, preferably from 5 mm to 10 mm.

The light that is received from the pixel during analysis is reflected by the scanner into a focusing element and injected into optical fibers for the purpose of its transmission into a spectrometer for analysis and evaluation.

The light that is received from the pixel is broken down into its constituent wavelengths in a spectrometer with a diffraction network, and the spectral data are used to classify the products for purposes of inspection or sorting, by combining the material and color information extracted from the recovered signal.

To do this, two sets of optical fibers that bring in the information to be processed and are obtained from the signal with different analyzers are used, namely:

A set of fibers that feeds a near-infrared spectrometer in order to determine the chemical composition;

Another set of fibers that feeds a set of sensors for determining the color using three filters that correspond to the colors with a red, green and blue base (RVB system).

Although this existing machine, corresponding essentially to the object of the above-mentioned document EP 1 243 350, is satisfactory, there is a persistent request for improvement of various points, namely:

A reduction in illumination requirements;

A better spatial stability of the analyzed region, which ensures the geometric quality of the reconstructed overall images, as well as the control of the levels of coverage of the conveyor belt that forms the conveying plane;

A better spectral stability of the measurements despite the defects linked to manufacturing tolerances of the analysis devices, such as the spectrometers;

An optimized combination of the information in the event of using at least two separate analysis devices.

SUMMARY OF THE INVENTION

This invention has as its essential object to improve a machine of the type that is disclosed by the document EP 1 243 350 for the purpose of responding at least in part to the above-mentioned request.

For this purpose, the invention has as its object a machine for automatic inspection of individual objects, arranged in an essentially single-layer way, of an integral surface product or of particular products distributed in an essentially continuous layer, traveling in a stream on a conveying plane, with said machine being, on the one hand, able and designed to distinguish objects, products or regions of a surface product according to their chemical composition and/or their color and comprising, on the other hand, at least one illumination station and at least one detection station under which the stream that is to be inspected passes, with the or each illumination station comprising in particular means for application and focusing of inspection radiation, obtained from one or more incoherent and wide-spectrum source(s), emitting said radiation in the direction of the conveying plane in such a way as to define an illumination plane, with the intersection of said illumination plane and conveying plane defining an illumination line that extends transversely to the direction of travel of the stream, as well as a focused illumination region in the form of a transverse strip, extending on both sides of said illumination line and in the conveying plane, with the or each detection station comprising in particular on the one hand, a detection means that makes it possible to scan periodically each point of the illumination line and that continuously receives the radiation that is reflected by an elementary measurement region or pixel that extends around the current scanned point, wherein this movable pixel defines, during the scanning of the illumination line by the detection means, a detection region in the form of a transverse strip, with this region having a dimension along an axis that is perpendicular to the direction of travel, corresponding to the inspection width of the detection station, and on the other hand, means for collecting and transmitting the multi-spectral radiation beam that is reflected to at least one analysis device, connected to or comprising an evaluation device, able and designed to carry out a processing of the signal that is contained in the pixel and transmitted by the collecting and transmission means, machine characterized in that the focused illumination region is contained in the detection region over the entire inspection width.

BRIEF DESCRIPTION OF THE DRAWINGS

The invention will be better understood owing to the description below, which relates to a preferred embodiment, provided by way of a non-limiting example and explained with reference to the accompanying diagrammatic drawings, in which:

FIG. 4A shows the consequences of spatial instabilities of the images that are obtained in the event of non-confined illumination, whereas FIG. 4B illustrates the spatial stability of images obtained with a machine according to the invention, and whereas

The partial FIGS. 5A and 5B illustrate the effect of an off-centering of the illuminated region in the event of a non-confined illumination, whereas the partial FIGS. 6A and 6B illustrate the effect of this same off-centering within the framework of the invention, i.e., in the event of a confined illumination.

DESCRIPTION OF THE PREFERRED EMBODIMENTS

Figure 1:
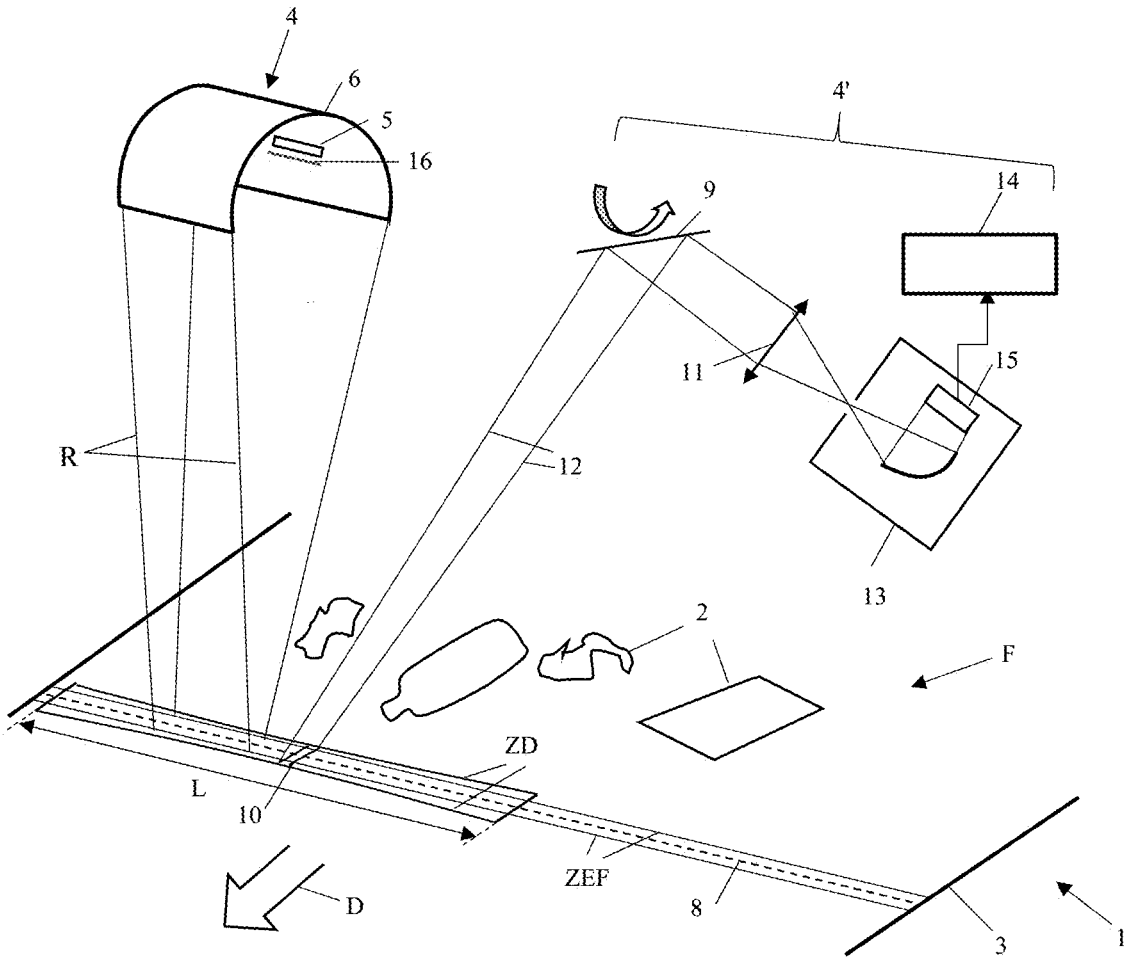
FIG. 1 is a diagrammatic partial view of the machine according to the invention illustrating more particularly the detection station.
Figure 1A:
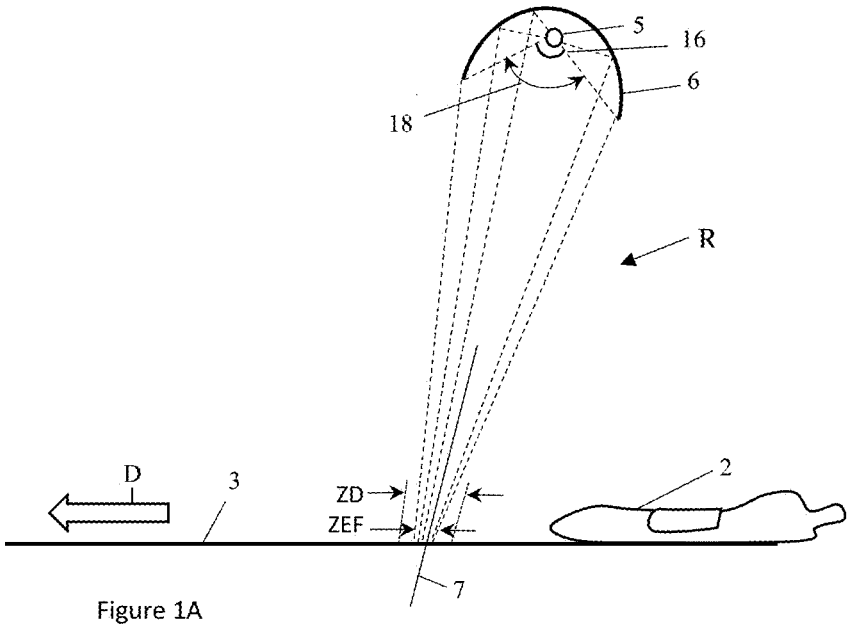
FIG. 1A is a cutaway view along a plane that is perpendicular to the conveying plane and to the illumination plane of the object shown in FIG. 1.

FIGS. 1 and 1A illustrate in part a machine 1 for automatic inspection of individual objects 2, arranged in an essentially single-layer way, of an integral surface product or particular products distributed in an essentially continuous layer, traveling in a stream F on a conveying plane 3, with said machine 1 being, on the one hand, able and designed to distinguish objects, products or regions of a surface product according to their chemical composition and/or their color and comprising, on the other hand, at least one illumination station 4 and at least one detection station 4' under which the stream F that is to be inspected passes.

This or each illumination station 4 comprises in particular means 6 for applying and focusing inspection radiation R, obtained from one or more incoherent and wide-spectrum source(s) 5, emitting said radiation R in the direction of the conveying plane 3 in such a way as to define an illumination plane 7, with the intersection of said illumination plane 7 and conveying plane 3 defining an illumination line 8 that extends transversely to the direction D of travel of the stream F, as well as a focused illumination region ZEF in the form of a transverse strip, extending on both sides of said illumination line 8 and in the conveying plane 3.

The or each detection station 4' comprises in particular:

On the one hand, a detection means 9 that makes it possible to scan periodically each point of the illumination line 8 and that continuously receives the radiation that is reflected by an elementary measurement region or pixel 10 that extends around the current scanned point, where this movable pixel 10 defines, during the scanning of the illumination line 8 by the detection means 9, a detection region ZD in the form of a transverse strip, with this region ZD having a dimension L along an axis that is perpendicular to the direction D of travel, corresponding to the inspection width of the detection station 4', and on the other hand, means 9, 11 for collecting and transmitting the multispectral radiation beam 12 that is reflected to at least one acquisition device 13, connected to an analysis device 14, able and designed to carry out a processing of the signal that is contained in the pixel 10 and transmitted by the collecting and transmission means 9, 11.

In accordance with the invention, this machine 1 is characterized in that the focused illumination region ZEF is contained, i.e., preferably strictly encompassed, in (within) the detection region ZD in the entire width L.

Still in accordance with the invention, it is provided that the scanning movable pixel 10 has a determined extension in the direction D of the axis of travel of the stream F, with upstream and downstream limits or edges 10', and that the application and focusing means 5, 6 are configured to carry out a confinement of the illumination such that, during the entire movement of the movable pixel 10 on or in the vicinity of the conveying plane 3, the upstream and downstream limits or edges of the illumination region ZEF in the direction D of travel are always contained inside the upstream and downstream limits or edges 10' of said pixel 10 in said direction D of travel.

Owing to the above-mentioned provisions of the invention, which take the opposite course to the overflowing illumination specified by the state of the art, one skilled in the art understands that in addition to the reduction of the illumination power resulting from their implementation, it is also possible to ensure good spatial and spectral stability of the region that is analyzed, as well as to easily obtain alignment among several acquisition and analysis devices of the spectrometer type, as indicated below in more detail.

Preferably, the two regions ZEF and ZD are both essentially centered on the illumination plane 7 and therefore in relation to the illumination line 8.

Also, in accordance with an advantageous design variant of the invention, resulting in the elimination of any material transmission support or means of the reflected and collected radiation beam 12, such as a fiber-optic beam that is used in the state of the art, the form of the scanning movable pixel 10 is determined by the form of the sensors or the arrangement of the sensors 15 that are part of said at least one acquisition and analysis device 13, 14 and/or by the form of the intake opening 13' of reflected radiation from the device 13 that comprises these sensors 15, with said pixel 10 preferably having an elongated rectangular shape in the direction D of travel.

In a preferred manner and to preserve a high-performance operation of the analysis device, while ensuring the above-mentioned advantages of a confined illumination according to the invention, it is provided that the illuminated region 10" of the movable pixel 10 during its scanning movement along the illumination line 8, i.e., its common surface with the focused illumination region ZEF, represents less than 80% of the total surface of said pixel 10, and advantageously at least 30%, preferably at least 40%, of this surface. A level of between 60% and 80% is preferred, with 70% seeming to be an essentially optimum value for most cases.

For the purpose of optimizing the performance of the machine even more in terms of illumination and to reduce, and even to eliminate, the interference or disturbance in this aspect, the application and focusing means preferably comprise means 6 for the reflection and confinement of the radiation that is obtained from the source(s) 5, as well as means 16 for stopping the radiation that is emitted directly by this or these source(s) toward said conveying plane 3 and located in a determined angular sector 18, in such a way that all of the radiation R received on the conveying plane 3 passes via the focusing means 6 and ends in the focused illumination region ZEF.

Of course, these means 5, 6 and 16 can be either units or modules, or partly modules and partly units.

Based on the nature of the inspection, the desired information and/or products/objects 2 to be characterized, various modes for adjusting and operating the machine 1 can be considered.

Thus, to be able in particular to ensure coverage of 100% of the traveling stream F, the scanning frequency that is defined by the detection means 9 can be regulated to be able to be adjusted to the travel speed of the stream F in such a way that, during the scanning of two successive lines, the confined illumination regions ZEF of each of these lines illuminate over the traveling conveying plane 3 of the portions in the form of transverse strips that are exactly contiguous in the direction D of travel, in such a way as to analyze at least once every point of the traveling stream F.

For a different inspection opening of 100%, namely less than or greater than this value, the scanning frequency defined by the detection means 9 can be regulated to be able to be adjusted to the travel speed of the stream F in such a way that, during the scanning of two successive lines, the confined illumination regions ZEF of each of these lines illuminate over the traveling conveying plane 3 of the surfaces in the form of transverse strips that are either separated by a set and monitored distance or that have a coverage over a distance or with a set and monitored level.

In accordance with a preferred design variant of the machine 1, the detection means 9 and the collecting and transmission means 9, 11 are part of the same optical arrangement corresponding to a detection station 4' and comprising, on the one hand, a scanner mirror 9 and at least one focusing element 11 and configured, on the other hand, to collect and to transmit the image that is present in the pixel 10 to at least one acquisition and analysis device 13, 14, advantageously through an intake opening 13' in the form of a rectangular slot.

FIG. 1 shows only a part or a module of the single illumination station 4 that provides a confined illumination region ZEF preferably over the entire width of the conveying plane 3. When several illumination modules are provided, the latter are, of course, aligned with one another with an abutment in a direction that is perpendicular to D.

Likewise, for the sake of simplicity, FIG. 1 shows only one detection station 4' on the two stations that the machine 1 has, with said machine shown partially in this FIG. 1. The second station 4', not shown but identical to the one that is shown, has an aligned detection region abutting the region 2D that is shown and that extends over the remaining transverse part of the conveying plane 3. Of course, the two detection stations 4' are aligned with the illumination station 4, or vice versa.

Advantageously, the scanner mirror 9 is a rotating multi-faceted polygonal mirror, whose speed of rotation can advantageously be regulated, with the focusing element 11 able to be of the refractory type, such as a lens, or of the reflecting type, such as an off-axis parabolic mirror.

Figure 3A:
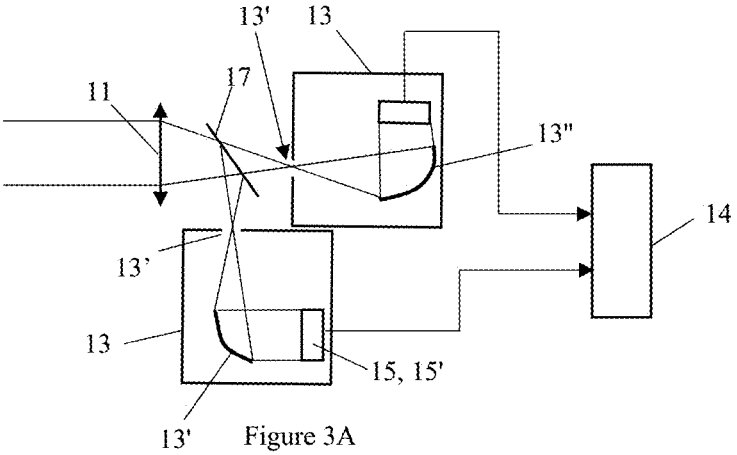
FIG. 3A illustrates a possible assembly of two spectrometers that are part of a variant of the detection station of the machine of FIG. 1.

Although the machine 1 can optionally comprise only one acquisition device 13 (optionally one per inspection station 4) for the or each beam 12 (FIG. 1), the machine 1 preferably comprises at least two separate acquisition devices 13, advantageously of different types, such as an NIR-type spectrometer for the analysis of near-infrared radiation and a VIS-type spectrometer for the analysis of visible radiation, an optical means 17 for subdivision of the light beam 12 of the reflected radiation, forming the image that is contained in the scanning movable pixel 10 (with the latter defining the useful part of said beam 12), into several secondary beams that are each directed toward one of the acquisition devices 13, for example of the dichroic filter type (FIG. 3A).

Whereas the machine 1 comprises only one illumination station 4, optionally with a modular structure, it is obvious that the machine 1 can comprise a single detection station 4' or several such stations, whose inspection widths L add up.

In this latter case, the detection means 9, the collecting and transmission means 9, 11 and said at least one acquisition device 13 and optionally analysis device 14 can be grouped into one structural and operational unit that forms a modular detection head and that corresponds to a detection station 4'.

In addition, in the case of a plurality of detection stations 4', each can comprise two different spectrometers 13.

Figure 1B:
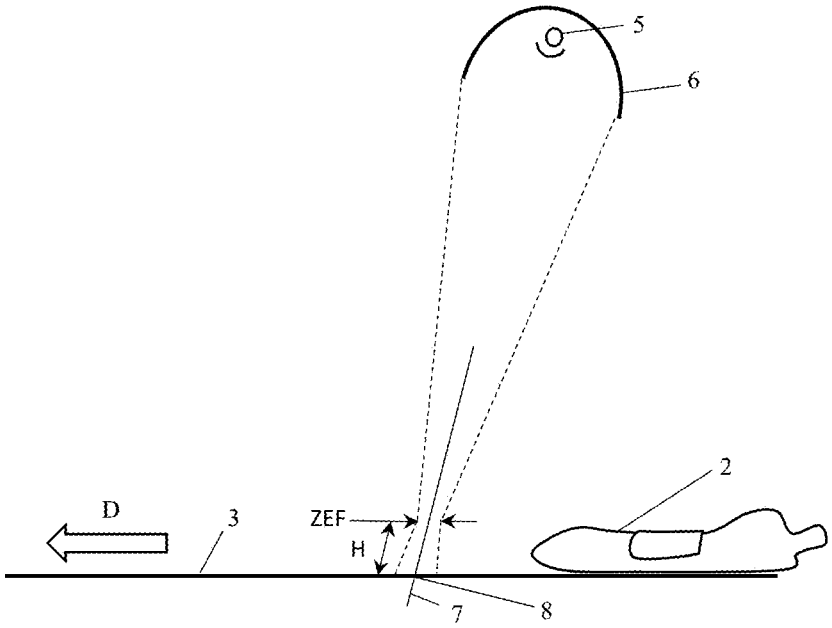
FIG. 1B is a view that is similar to FIG. 1A but with a focusing of the illumination at a given distance above the conveying plane.

So as to optimize the illumination to promote the detection, and as FIG. 1B shows, the application and focusing means 5, 6 of the radiation R in confined illumination form according to the invention can be arranged, configured and sized in such a way that the line for focusing the incident confined radiation R, forming part of the illumination plane 7, is located at a determined distance H above the conveying plane 3, with this distance able in particular to be based on the average size of the objects 2 that are to be inspected or the thickness of the traveling product(s) layer.

It will be noted that the projection in the direction of the detection plane over the conveying plane 3 of this focusing line normally corresponds to the illumination line 8.

The invention also has as its object a method for automatic inspection of individual objects 2, arranged in an essentially single-layer way, from an integral surface product or particular products distributed in an essentially continuous layer, traveling in a stream F over a conveying plane 3, with said method being able and designed to distinguish objects, products or regions of a surface product according to their chemical composition and/or their color, and using at least one illumination station 4 and at least one detection station 4' under which the stream F that is to be inspected passes.

This method essentially consists in:

emitting, by means of application and focusing means 6, inspection radiation R, obtained from one or more incoherent and wide-spectrum source(s) 5, in the direction of the conveying plane 3 in such a way as to define an illumination plane 7, with the intersection of said illumination plane 7 and the conveying plane 3 defining an illumination line 8 that extends transversely to the direction D of travel of the stream F, and creating a focused illumination region ZEF in the form of a transverse strip, extending on both sides of said illumination line 8 and in the conveying plane 3, periodically scanning, with a detection means 9, each point of the illumination line 8, and continuously recovering the radiation that is reflected by an elementary measurement region or pixel 10 extending around the current scanned point, with this movable pixel 10 defining, during the scanning of the illumination line 8 by the detection means 9, a detection region ZD in the form of a transverse strip, with this region ZD having a dimension L along an axis that is perpendicular to the direction D of travel, corresponding to the inspection width, collecting the beam 12 of reflected multi-spectral radiation and transmitting it to at least one acquisition device 13, connected to an analysis device 14, by means of the adapted means 9, 11, and sequentially or repetitively carrying out a processing of the signal that is contained in the pixel 10 and transmitted by the collecting and transmission means 9, 11, with the various means 5, 6, 9, 11, 13, 14 all forming part of at least one detection station 4' or at least one illumination station 4 respectively.

This method is characterized in that, during the course of the various above-mentioned operational steps, the focused illumination region ZEF is contained in the detection region ZD over the entire inspection width L.

Preferably, the above-mentioned method uses a machine 1 such as the one described previously and presented in detail below.

A more detailed description of the composition and operation of a possible variant embodiment of the machine 1 according to the invention and advantages that it has is disclosed below, in connection with FIGS. 1, 1A and 2 to 6.

First of all, with reference to FIGS. 1 and 1A, it is noted that the machine 1 comprises at least one thermal and multi-spectral light source 5, for example a tube that contains a tungsten-halogen filament, which provides wide-spectrum light in the visible and near-infrared ranges. A reflector 6 combined with the source 5 focuses all of the rays that reach it toward an illumination line 8 that is located on the conveying plane 3 formed by a conveyor belt. As in the document EP 1 243 350, the shape of the reflector 6 is cylindro-elliptical; the filament of the tube 5 is placed at one of the focal points of the ellipse and creates in the opposite focal point an enlarged image of this filament. This other focal point is located in the vicinity of the belt 3. This image defines a focused illumination region ZEF in the vicinity of the line 8. The region ZEF is enlarged by the set magnification, for example, on the order of 10 to 25, preferably on the order of 15 to 20. If, for example, this filament has a diameter of 1 mm and the magnification is 18, the height of the region ZEF will be 18 mm (height is referenced for pixels and images in top view, i.e., their size in the direction D of travel of the objects 2).

These are the spectral signals that are contained in these successively processed elementary images that contain useful information for distinguishing products or objects.

This height is maintained over the entire inspection width L, because there is no defocusing on the transverse axis of the belt. Both optical theory and the measurements made by the inventors confirm that illumination intensity is essentially homogeneous in the entire region ZEF and that it abruptly collapses at the top or bottom edge of said region ZEF (upstream and downstream limits of this region in the direction D of travel of the belt 3 of the objects 2).

Of course, the application and focusing means can have a modular composition with multiple units [tube 5+reflector 6] that are aligned in the transverse direction of the belt 3.

In practice, it is also necessary to take into consideration the residual illumination that does not pass via the reflector 6, i.e., the direct illumination, whose illumination intensity is approximately 100 times weaker on the belt 3 in the vicinity of the region ZEF. It is possible to conceal this residual illumination by a mask or a stop piece 16 located in the vicinity of the halogen tube 5, or even on the tube itself. The elimination of the residual illumination results in concentrating all of the radiation R that reaches the belt 3 in the region ZEF.

The detection system is, if not structurally at least optically, centered on the illumination line 8. At any time, the light beam 12 that is obtained from an elementary region 10, called a pixel and located in the region ZEF, in which it moves based on the scanning movement of the means 9, for example a scanner mirror, is captured and redirected by said means 9. The rotary movement of the scanner 9 makes it possible to scan with the pixel 10 a wide detection field ZD that extends across the conveyor belt 3. The scanner 9 can be of the oscillating mirror type or polygonal mirror type.

The beam 12 that is deflected by the scanner 9 is focused by a focusing element 11 toward the intake slot 13' of at least one spectrometer 13. Inside the spectrometer 13, the light is sent to a diffraction network 13" and distributed according to its spectral composition on a bar 15' that comprises several photodiode-type sensors 15. These sensors 15 may or may not be evenly spaced inside the bar 15'. The signal that is received by each sensor 15 is amplified and then digitized by a suitable electronic unit (not shown). The spectrum constituted by all of the responses of the sensors 15 is analyzed in real time by a computer device 14 that makes it possible to classify the surface that is contained in the pixel 10 in a family of products or objects 2 that are to be sorted.

The optional subsequent steps comprise a processing cycle of aggregation and formation of overall images that group the elementary images of the contiguous pixels 10 acquired during the successive transverse scans to define representations of homogeneous objects 2, whose surfaces and shapes can be determined and that may or may not be chosen to be ejected, selected, categorized. Finally, in the case where the detection station(s) 4' is/are part of a sorting machine 1, ejection instructions are sent to a small compressed-air solenoid valve bar (forming part of the machine but not shown), located at the end of the conveyor 3, and thus make it possible to deflect the object 2 in question from its natural drop path, either upward or downward, into a suitable container.

To declutter FIGS. 1 and 1A, the possible subdivision of the light beam 12 into two NIR (near-infrared) and VIS (visible) components is no longer shown, carried out by a dichroic mirror upstream from the spectrometers. The spectrometer 13 that is shown can therefore be an NIR spectrometer or a VIS spectrometer. A possible embodiment of such a subdivision by means of a dichroic filter is shown in FIG. 3A. This figure illustrates the separation of the light stream into its NIR component (traversing) and its VIS component (reflected). Each secondary light stream is focused, because of an adapted arrangement of the means 11 and 17, for passing through the specific intake slots 13' of each spectrometer 13.

At any time during an inspection process, the pixel 10 is the common image of all of the sensors 15 on the belt 3.

All of the successive positions of the movable pixel 10 during a scanning cycle of the transverse illumination line 8 constitutes the detection region ZD. With an optical magnification on the order of 20 for the NIR and sensors 15 of 1 mm in height, the height (or width) of the detection region ZD is therefore 20 mm, at least where the recovered elementary image is clear. Where the image is fuzzy, the height is greater, for example up to 23 mm on the sides of the field of vision. For a VIS pixel with a larger sensor 15, for example 1.5 mm, the height of the region ZD is 20×1.5=30 mm for a clear image, and up to 35 mm for the edges of the field.

According to the invention, the illumination is confined, i.e., the region ZEF is encompassed entirely in the detection region ZD, which implies that the height of the region ZEF, which is constant in this embodiment, is less than that of the region ZD. The height of the region ZD is variable, because the focusing of the movable pixel 10 can be perfect only for a given distance, and the distance from the scanner 9 to the conveying plane 3 is variable.

In the case of a bar of multi-line sensors 15, the bar 15' can have several parallel sensor lines, for example two or four lines; it is possible to consider them as a single line, whose height is more significant. According to the invention, the illumination is, in this case, confined in such a way that the total height of the various lines of superposed sensors is greater than that of the region ZEF.

The definition above is strictly applicable only to regions where the light is focused, whether this is for illumination or for the image of the sensors 15. This condition is verified exactly only for a single distance, whereas it is provided to detect objects and products 2 that have a certain height (size) above the belt 3. The illumination remains confined only near the belt 3, because the illumination beam (incident radiation R) is much more open than the detection beam 12. Within the framework of a practical embodiment of the invention as shown, it is possible to have angles of 20° to 30° total opening for the illumination beam R, versus less than 3° for the detection beam 12. The condition therefore can be met essentially only up to a few centimeters of the focal length, typically 50 mm. Nevertheless, this height is sufficient for the passage of almost all of a stream F, primarily if the incident radiation R is focused 10 mm to 20 mm above the belt 3, i.e., at the passage height of the majority of the objects or products 2.

To comply with the confined illumination condition according to the invention, it is necessary to take practical measures to comply with the adjustment and operating tolerances.

By a preliminary alignment procedure, first the illumination regions ZEF of the various reflectors 6 that are aligned transversely and that together cover the entirety of the inspection width L are aligned, and then the detection regions ZD of the optical arrangement(s) 9, 11 that constitute one or more detection stations 4'.

For example, the tolerance as regards the height of the image of the filaments of tubes 5 is carefully monitored, for example at +/−2 mm. It involves a tolerance of regulation: once regulated, the illumination line 8 is perfectly stable in space (preferably no more than one millimeter).

There is also a tolerance as regards the height (in the direction D) of the analyzed region ZD, in particular when the scanner 9 is a polygonal pivoting mirror: a typical value is +/−2 mm. The regulating ensures a fluctuation in this range during the operation. It is primarily the change in the reflecting face of the mirror 9 that creates an inevitable periodic oscillation, in particular when faces connected to a stationary frame are used. There is an alternative consisting in constructing the polygonal mirror with a machined single piece, but this is not a very economical solution.

By monitoring these tolerances and their possible accumulation, the risk of a part of the illuminated height not being in the detection region ZD can be extremely limited and even eliminated.

The preferred embodiment of the scanner 9 corresponds to a polygonal mirror that is guided at constant speed, with a motor that is slaved to the desired speed (regulatable). If, for example, the mirror 9 makes 17 revolutions per second and comprises 10 faces, it scans 170 lines per second, or 5.9 ms per line. If the belt advances at 3 m/s, it progresses by approximately 18 mm in one period. The height that is to be analyzed (dimension of the illumination strip ZEF in the direction D—common region with the detection strip ZD) is therefore ideally 18 mm at least so as not to have a detection hole. The speed of the mirror 9 can be adjusted to obtain the exact correspondence (coverage at 100% of the traveling stream).

This preferred embodiment makes it possible to manage several rates of advance of the belt 3 correctly, without losing the level of coverage of the belt: for example, 3 m/s and 4 m/s. For 4 m/s, it is sufficient to rotate the above-mentioned mirror 9 at 23.5 revolutions per second approximately for an ideal coverage at 100%.

It is easily possible to extend this reasoning to other coverage values, such as 90% (allowing a percentage that is deliberately not covered) or 120% (intentional coverage) if the user so desires. The preceding scheme therefore makes possible a flexible management.

The confined illumination according to the invention has numerous advantages disclosed below.

Figure 2:
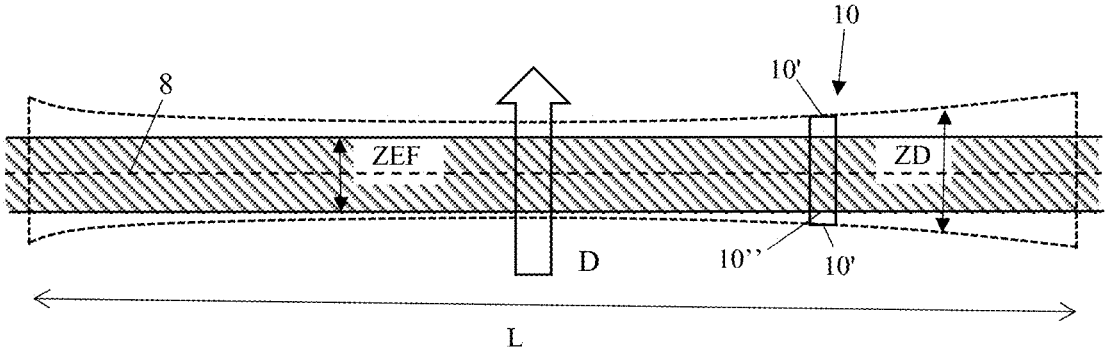
FIG. 2 shows the detail of the illumination and detection regions in the area of the conveying plane of the machine according to the invention.

FIG. 2 shows the respective positions of the region ZEF, the detection region ZD, and the movable pixel 10. Converging of the centers of these regions on the illumination line 8 is only true on average, in practice. At any time, the region ZEF can be slightly off-centered, as indicated.

All of the photons that are emitted from the intersection of the region ZEF and the pixel 10 (movable inspection window) and directed to the focusing element 11 via the scanner 9 contribute to the captured signal. Thus, the total illumination power that is necessary in significant proportions is reduced.

A covering illumination (correspondence of ZD =ZEF), and even overflowing illumination according to the state of the art, would make it necessary to take into account the fuzziness at the edge of the detection field, as well as the centering tolerances of the scanner mirror 9 during its rotation. To illuminate the image of the sensors 15 completely with the assumptions above, a height of 23 mm on the edge of the field, plus +/−2 mm of tolerance, or 27 mm overall, would then be necessary.

Thus, by passing from 27 mm for an overflowing illumination to 18 mm for a confined illumination, with the same local illumination intensity, a reduction in consumed electrical power of 33% is obtained. This same reduction is applied to the risks of overheating the objects 2 or of the conveying plane 3, in the event that the belt, of the conveyor belt or the like, is halted.

Figure 3B:
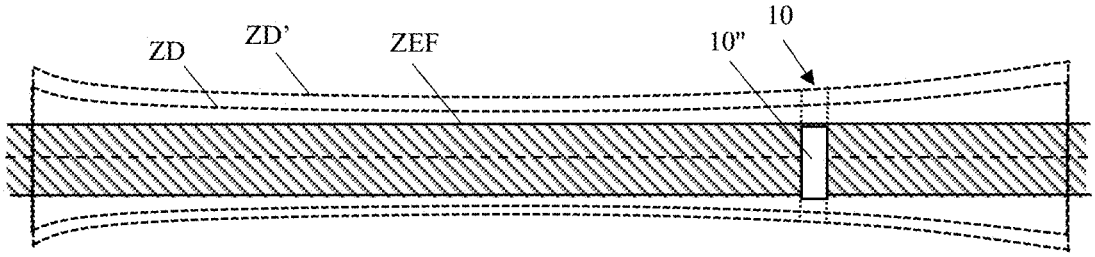
FIG. 3B shows the optimized combination of the detection regions in the area of the conveying plane of these two different spectrometers, according to an embodiment of the invention.

According to the invention, even with two spectrometers 13 that have bars 15' of sensors 15 of different heights, the same height is taken into account at any time, namely the one that is illuminated, thus allowing an exact and natural alignment among several spectrometers (FIG. 3B).

This situation is illustrated in FIG. 3B, showing a detection region ZD for the NIR and a larger detection region ZD' for the VIS. The captured light is always obtained from the intersection region of the pixel 10 with the region ZEF. However, this region or intersection region is exactly the same for the two spectrometers, NIR and VIS. With the dimensions that are mentioned above, even if the image of the pixel VIS has a height of 30 mm, only 20 mm will be effectively useful. Experience has shown to inventors the importance of complying with this condition for a good multi-sensor analysis of the pixel 10, with any alignment defect running the risk of resulting in the rejection of the analyzed pixel 10.

This natural correspondence avoids a very delicate alignment between the intake slots 13' of the two spectrometers 13 on the same optical assembly. These slots 13' should have exactly the same height and the same centering if the illumination was not confined. In relation to the invention, it is possible to use relatively high slots 13' without compromising the correspondence.

Figure 4A:
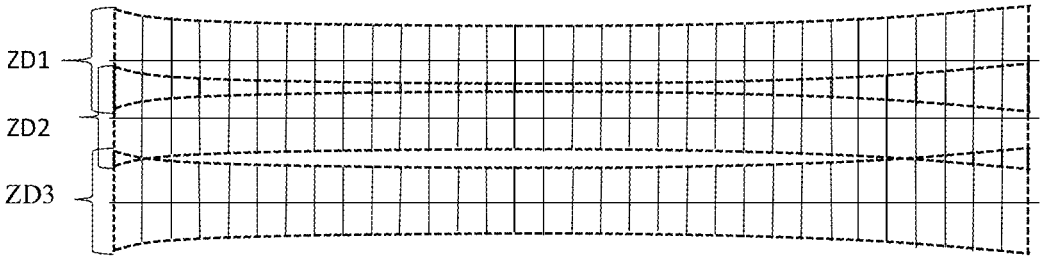
Figure 4B:
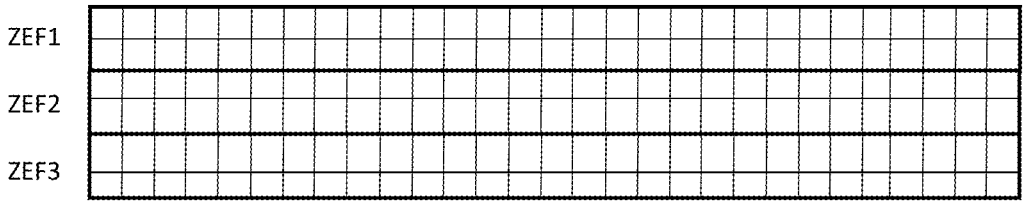
Figure 4C:
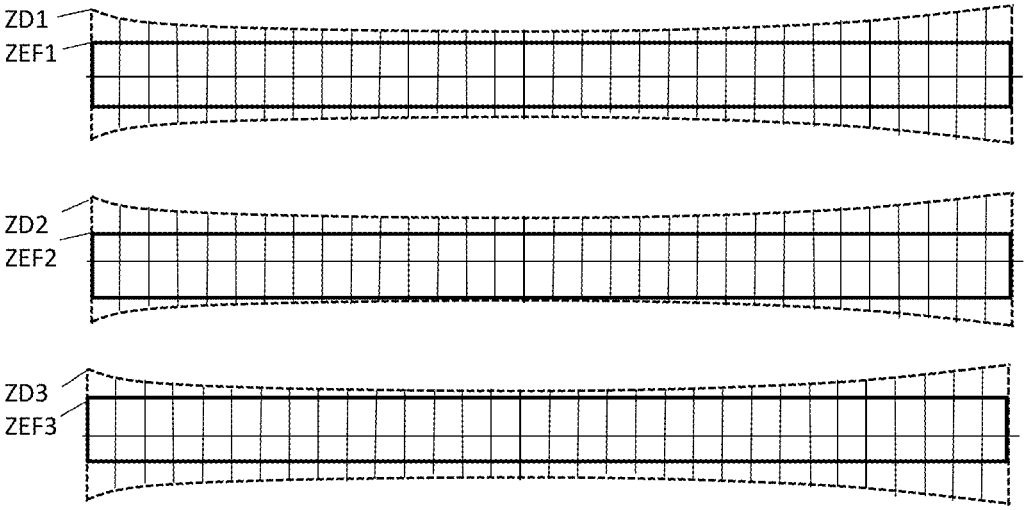
FIG. 4C shows the situation presented in detail of FIG. 4B.

It is noted that for the various cases shown in FIGS. 4A to 4C, the spectrometer 13 that is used comprises two rows of superposed sensors 15, in such a way as to obtain homogeneous spatial resolutions in the two axes.

With a good regulating of the rotation speeds of the multi-face (polygonal) pivoting scanner mirror 9 and the speed of the belt 3, there is an exact coverage of the belt of 100%. In contrast, with a wide and overflowing illumination according to the state of the art, taking into account the viewing tolerances of the mirror 9 in the travel axis (or height), the detected region would vary according to the passage of each face of the mirror (typically +/−2 mm), creating coverage areas or specific holes. This situation is illustrated in FIG. 4A: three successive lines are shown there in the case where the spectrometer comprises two rows of superposed sensors 15. It is clear that the two lines of sensors at the top have a coverage that, moreover, is variable and can become significant on the field edge, whereas the second and third lines have a gap between them with a detection hole, readily visible in the center of the field region.

In contrast, with an effective detection that is limited by the region ZEF that is stationary, this oscillation disappears (the only other source of instability linked to illumination would be a variable rate of advance of the belt, but such fast variations of this rate are not likely). This situation in accordance with the invention is illustrated in FIG. 4B, where the design of the two-dimensional image by a series of three lines is perfect (the latter are denoted ZEF1, ZEF2, and ZEF3).

The consequences of the off-centering of the regions ZD of each line are illustrated in FIG. 4C, where the three lines have been shown separately for clarity. ZEF1 is carefully centered with its detection region ZD1, ZEF2, either its detection region ZD2 offset toward the top and ZEF3 or, conversely, its detection region ZD3 offset toward the bottom. In any case, the information from each pixel 10 comes from its true position on the conveying plane 3 (belt, conveyor belt), but the relative illuminated surfaces seen by each sensor 15 vary. For example, the lower line of sensors 15 in ZD3 receives fewer signals that the upper line. Therefore, the signal levels can vary, but not the positions from which the signals come.

This spatial stability of the analyzed region obtains numerous advantages mentioned below.

The absence of a detection hole is the most natural objective. This can be important for seeking small objects 2 that it is absolutely necessary to remove: for example, PVC sheaths of electrical wires during sorting of CSR (solid recovery fuels) or non-PET flakes in a sorting of plastic flakes. In the absence of confined illumination, coverage that is systematic and that has a significant level is necessary to avoid the risk of detection holes.

It is also possible to wish to optimize the level of detection of the belt to gain productivity. For example, when it is known that the smallest object sought is 5 mm wide, it is possible to tolerate a detection hole of 2 mm to 3 mm between two successive detection lines or strips ZD. Careful control of the series of these lines or strips makes it possible to optimize this parameter without slack.

If, conversely, it is desired for safety reasons to have a detection coverage with a monitored redundancy level, for example to analyze each point twice, it is possible to guide a half-coverage precisely between two successive lines or strips ZD.

The perfect stability of the reconstructed two-dimensional image by aggregation makes possible a better image processing of the objects 2. The detection of angular or rounded contours is possible only if the successive lines are evenly spaced and the images of the pixels carefully aligned. For example, if a round object is displayed, it is easy to imagine that its appearance will be deformed over the image created from FIG. 4A. Conversely, its shape will be readily seen in FIG. 4B.

As indicated below, the use of a confined illumination according to the invention also has influence on the spectral stability of the analyzed region, in particular when the coverage of the illumination and detection regions is not perfect.

Figure 5:
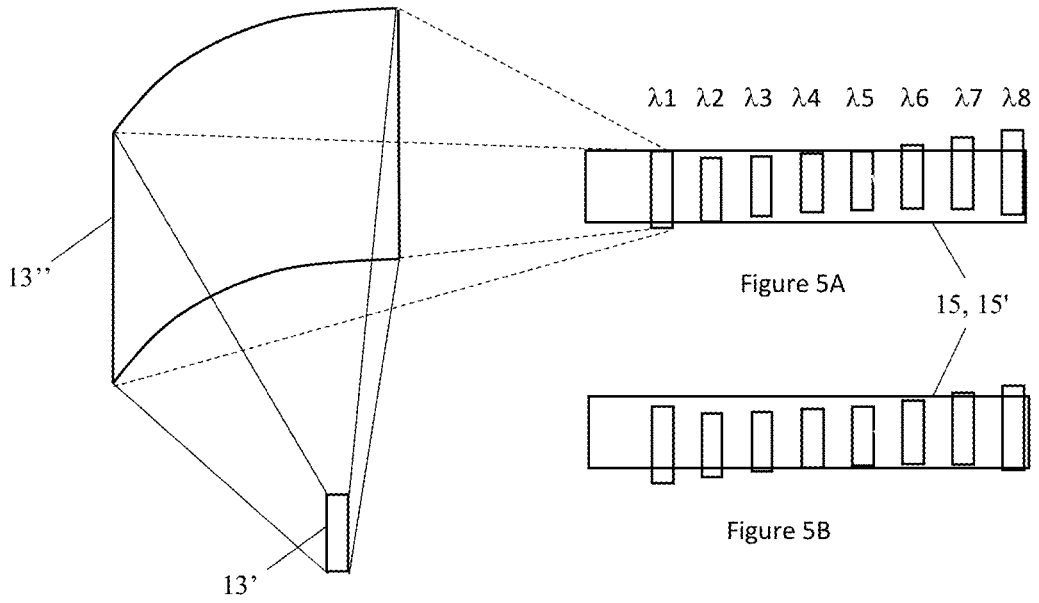
FIGS. 5 and 6 show the possible disruptions of the spectra due to optical defects of spectrometers that are part of the detection station according to the invention, with these disruptions being greatly exaggerated to facilitate understanding.
Figure 6:
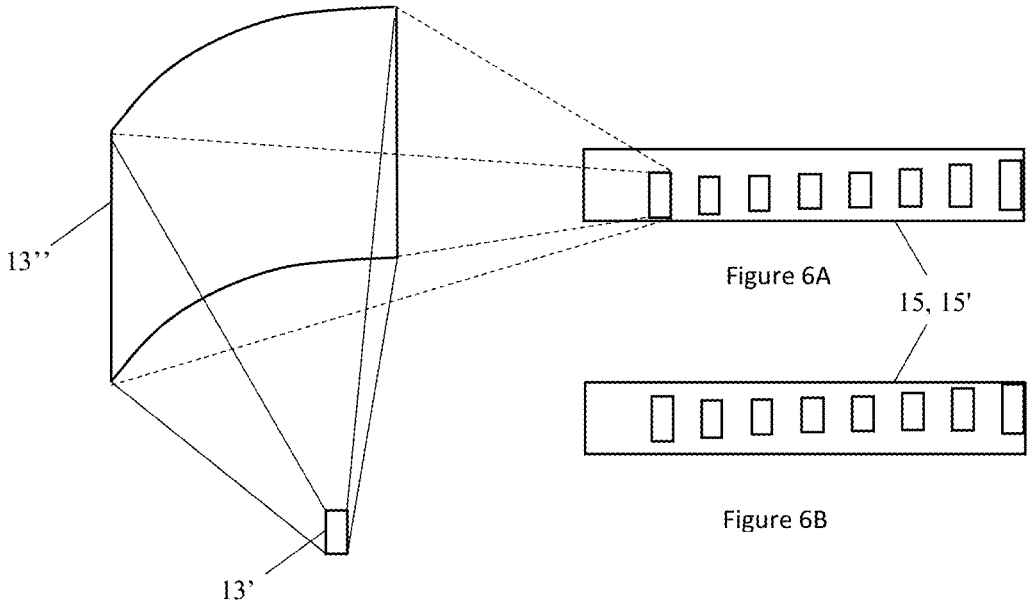

On this subject, it is possible to refer to FIGS. 5 and 6 that illustrate the various stations (FIG. 5: without implementation of the invention/FIG. 6: with implementation of the invention).

The incident light is focused on the slot 13', then it is distributed onto the network 13", where it is separated according to its spectral composition and refocused on the bar 15' that contains the individual sensors 15 (not shown). The light is separated according to N ranges of wavelengths (below, PLO). By way of example, the images of the slot 13' for eight different PLO, denoted λ1 to λ8, are shown in FIG. 5.

With the optical magnification of the system having a value of one, the image of the slot 13' for a PLO is a rectangle of the same dimensions as the slot 13', in the case of perfect optics.

To ensure high effectiveness of the spectrometer 13, the slot 13' should not limit the image of the sensors 15, and it should be at least as high as the sensors 15. In assuming that this is indeed the case, the illuminated part on the bar 15' then depends only on the illuminated portion on the intake slot 13', and this illuminated portion is a part of the image of the region ZEF in the area of the belt 3, which it is possible to refer to with "illuminated slot." It can move during the rotation of the polygon that is formed by the pivoting scanner mirror 9, or in the event of a malfunction of the reflector 6. Only the illuminated portion of the slot 13' is shown in FIGS. 5 and 6.

Like any physical assembly, a spectrometer 13 has manufacturing flaws, initial regulation flaws, or else flaws linked to aging or resulting from operating conditions. It is possible to cite two of them in particular, shown in FIGS. 5 and 6.

Because of an imperfect focusing, the image of the illuminated slot for a PLO can have a fuzziness and therefore be magnified and overflow the bar 15'. This case is shown for λl, λ7, and λ8.

The bar 15' of sensors 15 is not perfectly parallel to the output belt: PLO images are therefore higher at one end of the belt than at the other, and the corresponding sensors 15 run the risk of not being completely illuminated. FIGS. 6 and 7 show a rise from left to right of the image from the images of the PLO in relation to the bar 15'.

The consequences of this type of defect on the stability of the spectra are indicated below. That which characterize a spectrum within the context of the invention are not the absolute values of the luminance but the fixed relative proportions among the various PLO. Therefore, there will be a disruption of the spectrum each time that the response of a PLO is modified in proportions that are different from the other PLO.

If the image of the illuminated slot overflows from a sensor 15, without overflowing from the other sensors 15 in the same proportions, the analyzed spectral composition is affected. This is the case in FIG. 5. If a centered situation in FIG. 5A is compared to an off-centered situation in FIG. 5B, it is seen that the responses λ4 and λ5 are not affected, that λ6, λ7, and λ8 see their signals increase, whereas the signals of λ1, λ2, and λ3 decrease.

In contrast, if the illumination is carefully confined in accordance with the invention, i.e., the image of the illuminated slot on each sensor 15 does not reach the top or bottom edges of said sensor 15, all of the expected photons are captured. It is seen in FIG. 6 that the responses are not affected between the situations 6A and 6B, despite an off-centering that is identical to the one shown in FIG. 5.

It is clear that the confined illumination avoids affecting the spectral composition, provided that it is confined in the central part of each sensor 15 and with adequate margins.

These margins can advantageously be adjusted in such a way that, while still guaranteeing the attainment of the above-mentioned conditions of stability and of compensation for defects of manufacturing, construction and/or assembly, the inspection region (intersection of ZEF and ZD) is not overly restricted in height to prevent a reduction in the quantitative and qualitative performance of the machine 1.

Consequently, the provision according to the invention of an illumination region or line ZEF that is essentially more narrow than the detection region or line ZD readily constitutes the most stable configuration for managing the defects due to manufacturing tolerances and defects of the spectrometer 13 used for spectral analysis within the framework of the machine 1.

Of course, the invention is not limited to the embodiments that are described and shown in the accompanying drawings. Modifications are possible, in particular from the standpoint of the composition of the various elements or by substitution of equivalent techniques, without thereby exceeding the field of protection of the invention.

The invention claimed is:

1. A machine for automatic inspection of individual objects, the individual objects arranged in either a single-layer, or the individual objects having an integral surface product, or the individual objects being particular products distributed in a continuous layer, said machine comprising:

a stream on a conveying plane, said individual objects traveling in said stream on said conveying plane, said machine configured to distinguish the individual objects, products or regions of a surface product according to a chemical composition and/or a color said machine further comprising at least one illumination station and at least one detection station under which the stream that is to be inspected passes, with the or each illumination station comprising means for application and focusing of inspection radiation, obtained from one or more incoherent and wide-spectrum source(s), said at least one illumination station emitting said radiation in the direction of the conveying plane in such a way as to define i) an illumination plane, with the intersection of said illumination plane and the conveying plane defining an illumination line that extends transverse and substantially perpendicular to the direction of travel of the stream, and ii) a focused illumination region in the form of a strip, extending along and on both sides of said illumination line and on the conveying plane and also transverse and preferably perpendicular to the direction of travel of the stream, with the or each detection station comprising a detection means that enables periodic scanning of each point of the illumination line and that continuously receives the radiation that is reflected by an elementary measurement region that extends around a current scanned point, wherein said elementary measurement region defines, during the scanning of the illumination line by the detection means, a detection region in the form of a transverse strip, with said detection region having a dimension along a width axis that is perpendicular to the direction of travel of the stream, said dimension corresponding to the inspection width of the at least one detection station, and wherein the or each detection station further comprises means for collecting and transmitting a reflected multi-spectral radiation beam to at least one acquisition device, connected to an analysis device, able and designed to carry out a processing of the signal that is contained in the elementary measurement region and transmitted by the means for collecting and transmitting, wherein each of said at least one illumination stations are configured to produce the focused illumination region such that it is contained within the detection region over an entire inspection width of each of said at least one detection station.

2. The machine according to claim 1, wherein a scanning region has a determined extension in the direction of the axis of travel of the stream, with upstream and downstream limits or edges, and wherein the means for application and focusing are configured to carry out a confinement of illumination such that, during the entire movement of the elementary measurement region on or in the vicinity of the conveying plane, the upstream and downstream limits or edges of the focused illumination region in the direction of travel are always contained inside the upstream and downstream limits or edges of said scanning region in said direction of travel.

3. The machine according to claim 1, wherein an illuminated region of the elementary measurement region, during scanning movement along the illumination line which is a common surface with the focused illumination region, represents less than 80% of the total surface of said elementary measurement region.

4. The machine according to claim 1, wherein the means for application and focusing comprise means for the reflection and confinement of the radiation that is obtained from the source(s), as well as means for stopping the radiation that is emitted directly by said source(s) toward said conveying plane and located in a determined angular sector, in such a way that all of the radiation received on the conveying plane passes via the means for application and focusing and ends in the focused illumination region.

5. The machine according to claim 1, wherein a scanning frequency that is defined by the detection means can be regulated to be able to be adjusted to the travel speed of the stream in such a way that, during scanning of two successive lines, confined illumination regions of each of these lines illuminate over the conveying plane portions in the form of transverse strips that are exactly contiguous in the direction of travel, in such a way as to analyze at least once every point of the stream.

6. The machine according to claim 1, wherein a scanning frequency defined by the detection means can be regulated to be able to be adjusted to the travel speed of the stream in such a way that, during scanning of two successive lines, confined illumination regions of each of these lines illuminate over the conveying plane surfaces in the form of said transverse strips that are either separated by a set and monitored distance or that have a coverage over a distance or with a set and monitored level.

7. The machine according to claim 1, wherein a scanner mirror is a rotating multi-faceted polygonal mirror, whose speed of rotation can be regulated, with a focusing element being a refractory lens or a reflecting off-axis parabolic mirror.

8. The machine according to claim 1, wherein the detection means, the means for collecting and transmitting, and said at least one acquisition device and analysis device, are grouped into one structural and operational unit that forms a modular detection head and that corresponds to said detection station.

9. A method for automatic inspection of individual objects, the individual objects arranged either in a single-layer, or the individual objects having an integral surface product, or the individual objects being distributed in a continuous layer, said individual objects configured to travel in a stream over a conveying plane, said method comprising the steps of distinguishing the individual objects, products or regions of a surface product according to their chemical composition and/or their color, said method including using at least one illumination station and at least one detection station under which the stream that is to be inspected passes, said method including:

emitting, by means of application and focusing means, inspection radiation, obtained from one or more incoherent and wide-spectrum source(s), in the direction of the conveying plane in such a way as to define an illumination plane, with the intersection of said illumination plane and the conveying plane defining an illumination line that extends transversely to the direction of travel of the stream and creating a focused illumination region in the form of a transverse strip, extending on both sides of said illumination line and in the conveying plane, periodically scanning, with a detection means, each point of the illumination line, and continuously recovering the radiation that is reflected by an elementary measurement region extending around the current scanned point, with said elementary measurement region defining, during the scanning of the illumination line by the detection means, a detection region in the form of a transverse strip, with said detection region having a dimension along an axis that is perpendicular to the direction of travel of the stream, said dimension corresponding to an inspection width, collecting a beam of reflected multi-spectral radiation and transmitting said beam of reflected multi-spectral radiation to at least one acquisition device, connected to an analysis device, by means of an adapted means, and sequentially or repetitively carrying out a processing of the signal that is contained in the elementary measurement region and transmitted by the means for collecting and transmitting, with the adapted means and said means for collecting and transmitting all forming part of said at least one illumination station and/or said at least one detection station, wherein during the course of the various above-mentioned operational steps, the focused illumination region produced by each of said at least one illumination stations is contained within the detection region over the entire inspection width.

10. The method according to claim 9, performed using a machine for automatic inspection of the individual objects, the individual objects arranged either in a single-layer, or the individual objects having an integral surface product, or the individual objects being products distributed in an essentially continuous layer, the individual objects traveling in the stream on the conveying plane, said method being implemented on the machine for automatic inspection configured to distinguish the individual objects, products or regions of a surface product according to chemical composition and/or their color, said machine also comprising said at least one illumination station and said at least one detection station under which the stream that is to be inspected passes, with the or each illumination station comprising the means for application and focusing of inspection radiation, obtained from said one or more incoherent and wide-spectrum source(s), emitting said radiation in the direction of the conveying plane in such a way as to define said illumination plane, with the intersection of said illumination plane and conveying plane defining the illumination line that extends transversely to the direction of travel of the stream, as well as the focused illumination region in the form of a transverse strip, extending on both sides of said illumination line and in the conveying plane, with the or each detection station comprising a detection means that enables periodic scanning of each point of the illumination line and that continuously receives the radiation that is reflected by an elementary measurement region that extends around the current scanned point, wherein this region defines, during the scanning of the illumination line by the detection means, the detection region in the form of a transverse strip, with this region having a dimension along an axis that is perpendicular to the direction of travel, said dimension corresponding to the inspection width of the detection station, and also comprising means for collecting and transmitting the reflected multi-spectral radiation beam to said at least one acquisition device, connected to the analysis device, able and designed to carry out a processing of the signal that is contained in the region and transmitted by the means for collecting and transmitting, wherein the focused illumination region is contained within the detection region over the entire inspection width.

11. The machine according to claim 1, wherein the focused illuminated region within the elementary measurement region, during scanning movement along said illumination line which is a common surface with the focused illumination region, represents less than 80% of the total surface of said elementary measurement region, and at least 30% of this surface.

12. The machine according to claim 1, wherein the focused illuminated region of the elementary measurement region, during scanning movement along said illumination line which is a common surface with the focused illumination region, represents less than 80% of the total surface of said elementary measurement region, and at least 40% of this surface.

13. The machine according to claim 1, further comprising at least two separate acquisition devices of different types, comprising an NIR-type spectrometer for the analysis of near-infrared radiation and a VIS-type spectrometer for the analysis of visible radiation, an optical means for subdivision of the light beam of the reflected radiation, forming the image that is contained in the detection region into several secondary beams that are each directed toward one of the at least two acquisition devices by use of a dichroic filter.

14. The method according to claim 9, performed using said machine for automatic inspection of individual objects, the individual objects arranged either in a single-layer, or said objects having an integral surface product, or said objects being products distributed in a continuous layer, the individual objects traveling in the stream on the conveying plane, the machine configured to distinguish objects, products or regions of a surface product according to their chemical composition and/or their color, and said machine having said at least one illumination station and said at least one detection station under which the stream that is to be inspected passes, with the or each illumination station comprising said means for application and focusing of inspection radiation, obtained from said one or more incoherent and wide-spectrum source(s), the machine emitting said radiation in the direction of the conveying plane in such a way as to define said illumination plane, with the intersection of said illumination plane and conveying plane defining said illumination line that extends transversely to the direction of travel of the stream, as well as the focused illumination region in the form of a transverse strip, extending on both sides of said illumination line and in the conveying plane, with the or each detection station having the detection means that enables periodic scanning of each point of the illumination line and that continuously receives the radiation that is reflected by an elementary measurement region that extends around the current scanned point, wherein said elementary measurement region defines, during the scanning of the illumination line by the detection means, a detection region in the form of a transverse strip, with said detection region having a dimension along an axis that is perpendicular to the direction of travel, said dimension corresponding to the inspection width of the detection station, each detection station also having means for collecting and transmitting the reflected multi-spectral radiation beam to said at least one acquisition device, connected to said analysis device, able and designed to carry out a processing of the signal that is contained in the region and transmitted by the collecting and transmission means, wherein the focused illumination region is contained in the detection region over the entire inspection width, and wherein the focused illumination region has a determined extension in the direction of the axis of travel of the stream, with upstream and downstream limits or edges, and wherein the application and focusing means are configured to carry out a confinement of the illumination such that, during the entire movement of the elementary measurement region on or in the vicinity of the conveying plane, the upstream and downstream limits or edges of the illumination region in the direction of travel are always contained inside the upstream and downstream limits or edges of said elementary measurement region in said direction of travel.

* * * * *